US011490486B2

(12) United States Patent
Boudikian et al.

(10) Patent No.: US 11,490,486 B2
(45) Date of Patent: Nov. 1, 2022

(54) METHOD FOR MAINTAINING LUMINOSITY WHEN SWITCHING INPUT POWER IN AUTOMOTIVE LIGHTING DEVICES

(71) Applicant: VALEO VISION, Bobigny (FR)

(72) Inventors: David Boudikian, Bobigny (FR); Clément Fabris, Bobigny (FR); José Afonso, Bobigny (FR)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 17/415,822

(22) PCT Filed: Dec. 16, 2019

(86) PCT No.: PCT/EP2019/085288

§ 371 (c)(1),
(2) Date: Jun. 18, 2021

(87) PCT Pub. No.: WO2020/127001

PCT Pub. Date: Jun. 25, 2020

(65) Prior Publication Data

US 2022/0061138 A1 Feb. 24, 2022

(30) Foreign Application Priority Data

Dec. 21, 2018 (EP) ..... 18215705

(51) Int. Cl.

| | |
|---|---|
| ***H05B 45/32*** | (2020.01) |
| ***H05B 45/50*** | (2022.01) |
| ***H05B 45/325*** | (2020.01) |
| ***H05B 45/3725*** | (2020.01) |

(52) U.S. Cl.

CPC ..... *H05B 45/50* (2020.01); *H05B 45/325* (2020.01); *H05B 45/3725* (2020.01)

(58) Field of Classification Search

CPC ..... H05B 45/10; H05B 45/30; H05B 45/325; H05B 45/3725; H05B 45/50; H05B 47/00

See application file for complete search history.

(56) References Cited

U.S. PATENT DOCUMENTS

| | | | | |
|---|---|---|---|---|
| 7,557,524 | B2 * | 7/2009 | Chevalier | H05B 47/175 315/318 |
| 2011/0062888 | A1 * | 3/2011 | Bondy | H05B 45/10 315/294 |
| 2017/0188419 | A1 | 6/2017 | Gaertner et al. | |
| 2018/0343722 | A1 | 11/2018 | Matsui et al. | |
| 2019/0306841 | A1 | 10/2019 | Gaertner et al. | |

OTHER PUBLICATIONS

International Search Report dated Feb. 19, 2020 in PCT/EP2019/085288 filed Dec. 16, 2019.

* cited by examiner

*Primary Examiner* — Jimmy T Vu

(74) *Attorney, Agent, or Firm* — Oblon, McClelland, Maier & Neustadt, L.L.P.

(57) ABSTRACT

A method for a driver device of an automotive lighting device that includes at least two inputs for receiving one electricity supply each, and a power converter circuit for selectively converting the electricity supplied on one of the inputs into a periodic power supply for powering said lighting device. The method allows for switching between inputs of the driver device while reducing the power supply shortage which generally arises at the time of switching inputs. This allows for providing generally flicker-free luminosity while using a single converter circuit.

17 Claims, 1 Drawing Sheet

METHOD FOR MAINTAINING LUMINOSITY WHEN SWITCHING INPUT POWER IN AUTOMOTIVE LIGHTING DEVICES

The invention lies in the field of driver devices for automotive lighting devices, and in particular for automotive lighting devices involving electroluminescent components, such as light emitting diodes, LEDs.

It is increasingly common to use electroluminescent semiconductor components, such as light emitting diodes, LEDs in automotive lighting applications. LEDs are small components capable of producing beams having high luminosity at relatively low supply current intensities. Using LEDs, interesting lighting contours may be designed, while at the same time both space and electrical power is saved, as compared to incandescent light sources. When a voltage difference of a value equal or larger than a LED's forward voltage is applied to its two terminals, an electrical current flow through the LED and photons are emitted. Generally, the luminescence of a LED is an increasing function of the electrical current intensity that passes through it. As the luminescence is required to conform to predetermined regulations, it is important to carefully drive the intensity of the electrical current supplied to LEDs. It is known to use driver devices for driving the power supply of a LED, which generally use a DC/DC converter circuit to transform an electrical current having a first intensity, as supplied for example by an internal source of an automotive vehicle, such as a battery, into an electrical current having a second intensity, which is appropriate to power the LEDs.

In order to save both costs and space, it has been proposed to use a single converter circuit, which may selectively use one out of a plurality of available power inputs, in order to drive the power supply of a plurality of automotive lighting functions. When power inputs are switched, a slight power supply gap of up to several milliseconds may be observed, which may impact the behaviour of the lighting function.

This problem also arises in architectures that use time-sharing in conjunction with a single switched mode converter circuit having multiple power supply inputs that may be selectively used, for example to simultaneously supply different current intensities to different lighting functions of an automotive vehicle, such as parking lights, PL, turn indicator, TI or others. In such architectures, the output supply of the converter circuit, which is destined to different lighting functions, is multiplexed based on a time-division multiplexing process. The resources of the converter circuit are shared over time by different lighting functions. When for example a first and second lighting function are powered in combination using a first power supply input of the converter circuit, while powering the second lighting function on its own requires to switch to a second power supply input, a switching delay is generally observed when the first lighting function is switched off. While the second input is not yet fully available, the power on the first input has already dropped, so that not enough supply power is available. This delay may well be larger than for example 7 to 10 milliseconds, after which a drop in luminosity of the second function is observable. The issue arises routinely at any time when power inputs are switched, which is a common process. As a result, the corresponding second lighting function may exhibit visible luminosity variations such as flickering, which are undesirable in many applications.

It is an objective of the present invention to provide a method and system which overcomes at least some of the disadvantages of the prior art.

In accordance with a first aspect of the invention, a control method for a driver device of an automotive lighting device is proposed. The driver device comprises at least two inputs for receiving one electricity supply each, and a power converter circuit for selectively converting the electricity supplied on one of the inputs into a periodic power supply for powering said lighting device. The method is remarkable in that it comprises the steps of:

- while the lighting device is powered based on a first input, detecting an electricity supply drop on said first input using a detection circuit;
- generating, using a controlling unit, an estimate of the power that will be lost from the time of detection to the end of the ongoing power supply period;
- using the power converter circuit, generating a power supply for compensating said estimated power loss based on an electricity supply received on a second input, and powering said lighting device therewith.

Preferably, the power generated during said compensation step may be substantially equal to the power loss estimate.

Preferably, the step of generating an estimate of the power that will be lost from the time of detection to the end of the ongoing power supply period may comprise looking up a pre-recorded power value in a memory element, which associates power values with the corresponding timing information.

The power converter circuit may preferably be a switched mode converter circuit, which is controlled by a periodic control signal generated by said controlling unit, and during said compensation step, the control signal may preferably be adapted so that the converter circuit outputs the required compensating power.

Preferably, said control signal may be a pulse width modulated, PWM, signal, and during said compensation step, the duration of the ongoing or upcoming cycle may preferably be shortened, lengthened, or its duty cycle may be altered.

At least one of the inputs may preferably be used to simultaneously provide a periodic power supply to at least two lighting devices using time-sharing of the driver device.

According to yet another aspect of the invention a computer program is provided, which, when run on a computer, leads the computer to realize the method steps in accordance with aspects of the invention.

A computer program product is further provided. It comprises a computer readable medium on which the computer program in accordance with an aspect of the invention is stored.

In accordance with another aspect of the invention, a control system comprising a control unit and a driver device of an automotive lighting device is proposed. The driver device comprises at least two inputs for receiving one electricity supply each, and a power converter circuit for selectively converting the electricity supplied on one of the inputs into a periodic power supply for powering said lighting device. The control system is remarkable in that the control unit is configured for:

- detecting an electricity supply drop on said first input using a detection circuit while the lighting device is powered based on a first input;
- computing, using a controlling unit, an estimate of the power that will be lost from the time of detection to the end of the ongoing power supply period;
- controlling the power converter circuit, so that it generates a power supply for compensating said estimated power loss based on an electricity supply received on a second input, and powering said lighting device therewith.

The control unit may preferably comprise a microcontroller device operatively connected to said driver device.

Preferably, the power converter circuit may comprise a switched mode converter. The power converter may preferably comprise a buck converter, a boost converter or a boost/buck architecture. Preferably, the power converter circuit may comprise a single ended primary inductor converter, SEPIC.

By using the driver control method in accordance with aspects of the invention, it becomes possible to use a single driver device having a plurality of power inputs, while minimizing the power supply gap that is ensued when power inputs are switched, so that the visual impact in terms of the variation of luminosity of the powered lighting device is kept minimal or is eliminated altogether. In particular, in architectures that use time-sharing to power a first and second lighting function in conjunction with a single switched mode converter circuit having multiple power supply inputs that may be selectively used, the flickering that arises without using the control method in accordance with aspects of the invention is eliminated. As a result, lighting regulations, as applicable for automotive lighting devices, may be complied with in a wider range of usage scenarios. It should be noted that in accordance with prior art methods and devices, one would need to rely on two distinct power converter circuits to obtain a flicker-free performance for both the first and second lighting functions when one of the power inputs becomes unavailable. The method in accordance with the invention therefore allows for saving both space in the limited volume available to install the components of an automotive lighting system, and costs, as similar performance becomes achievable using a single converter circuit.

Several embodiments of the present invention are illustrated by way of figures, which do not limit the scope of the invention, wherein:

FIG. 1 provides a schematic illustration of system according to a preferred embodiment of the invention, for implementing the method according to a preferred embodiment of the invention;

This section describes features of the invention in further detail based on preferred embodiments and on the figures, without limiting the invention to the described embodiments. Unless otherwise stated, features of one described embodiment may be combined with additional features of another described embodiment.

Figure 1:
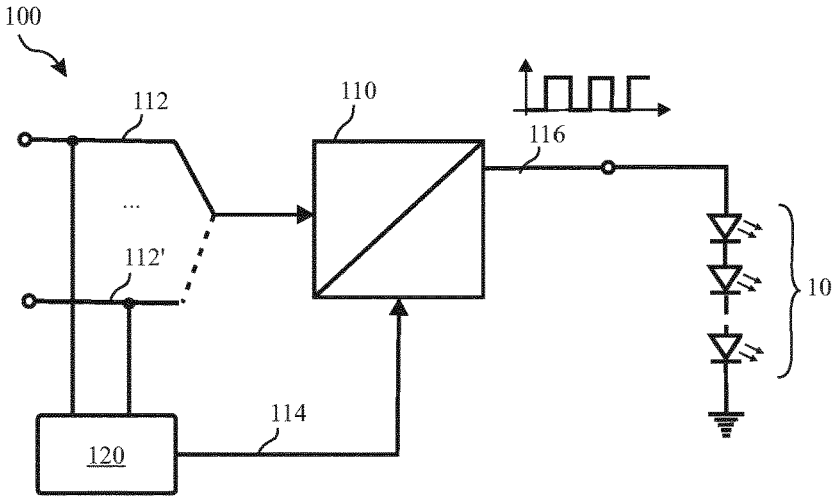

The description focuses on those aspect that are relevant for understanding the method and system in accordance with the invention. Driver devices and automotive lighting devices comprise other components that are well known in the art, which will not be explicitly mentioned. These include for example a heat dissipator, optical lenses, or structures for holding the respective components in place. FIG. 1 illustrates a preferred embodiment of a control system 100 that includes a driver device 110 of an automotive lighting device 10. The lighting device is schematically illustrated as comprising a series string of light emitting diodes, LED, but the invention is not limited to this example. The driver device is suitable for supplying electricity to the lighting device and comprises electronic circuitry to that effect. In particular, the driver device comprises means for selectively receiving a first input 112 and a second input 112'. The first and second inputs 112, 112' are electricity supplies, as provided for example by an electricity source that is internal to the automotive vehicle, such as a battery. Further electricity supplies beyond the number of two may be present without departing from the scope of the present invention. While in FIG. 1 a switching circuit is illustrated for selecting one of the electricity supplies 112, 112', equivalently, each one of the inputs may be permanently connected to the driver device 110, while electricity is selectively supplied on either of them. The driver's behaviour is influenced and controlled using a control signal 114 generated by a controlling unit 120. The driver device may further comprise other non-illustrated circuitry, for example a known converter circuit. The converter circuit may for example comprise a buck converter for lowering the power, a boost converter for raising the power, or a combined boost/buck architecture. It is for example known in the art to use switched mode converter circuits such as a single ended primary inductor converter, SEPIC. In such converters, the performance of the converter is controlled using a switching signal 114. The switching signal is applied to a control switch of the converter circuit, thereby defining its duty cycle. As a result, a periodic power supply 116 is generated at the output of the driver device.

Advantageously, the control signal 114 is a pulse width modulated PWM signal, which is a binary periodic signal having an ON state and an OFF state, and which is characterized by its duty cycle, i.e. the ratio between the duration of the ON state and the total period duration. By adapting the amplitude of the PWM signal, for example using a dedicated levelling circuit, and/or by changing the duty cycle using the controlling unit 120, different average values of the control signal 114, and therefore of the output power 116 are achievable.

A compensation can also be applied to the reference current going through the LEDs. Therefore, the invention is also applicable in situations where the LED control signal 114 is continuous.

Figure 2:
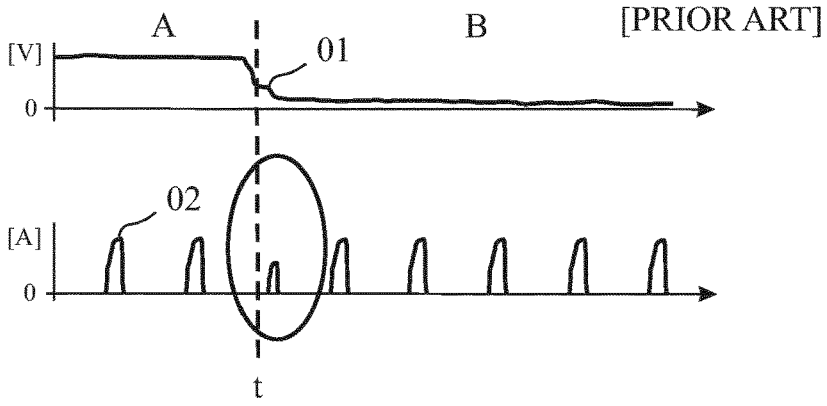
FIG. 2 illustrates the evolution in time of a power supply voltage (top) that is used to jointly supply a first and second lighting function of an automotive vehicle, and the evolution in time of the intensity of the electric current (bottom) powering the second lighting function, as observed using a driver control method as known from the prior art.

FIG. 2 provides an illustration of a specific problem that arises with prior art driver control methods in architectures that use time-sharing in conjunction with a single switched mode converter circuit having multiple power supply inputs that may be selectively used, for example to simultaneously supply different current intensities to different lighting functions of an automotive vehicle, such as parking lights, PL, and turn indicator, TI. In the depicted example, during a first timespan ranging from 0 to t and labelled by the capital letter "A", a first electricity supply provides input power to a switched-mode converter circuit. The output power supplied by the switched-mode converter circuit is multiplexed on a time-division multiplexing basis to supply both the PL and TI functions. At time t, the electricity supply on the first input of the driver vanishes, and the architecture is required to use the second electricity supply for powering the PL function alone. The top graph of FIG. 2 illustrates the evolution of the first electricity supply 01 as a function of time. During phase "A", the voltage 01 is applied to power both the TI and PL functions using timesharing, whereas during phase "B", starting in the shown example at time t, the voltage 01 drops to zero. In parallel, a positive voltage is available on the second electricity supply available to the converter circuit, the evolution of which is not illustrated. The bottom graph of FIG. 2 illustrates the evolution of the electrical current 02 passing through light emitting diodes, LEDs, that are part of the PL lighting function. The current evolves as a pulsed periodic signal having constant period and average value during phase A. During phase A, the electrical current 02 is provided to the PL LEDs using the first electricity supply and through the switched-mode converter circuit, using a multiplexing process through which the TI LEDs are also supplied with electrical current. At time t the electricity supply on the first input of the driver vanishes. For as long as the TI function is not confirmed to have been switched off both the TI and PL functions are required to be powered. This validation by a the driver of the LEDs typically takes several milliseconds. Once the first power source disappears, the driver needs to detect it in order to quickly switch to the second power input and to only supply dedicated function (PL in this case). The first current pulse that flows through the PL LEDs after time t has therefore low intensity, which results in a diminished luminosity of the PL LEDs. Once the TI has been confirmed as having been switched off, the TI function is no longer powered by the driver and the electricity supply on the second input of the driver device is used to power the PL LEDs alone. The available power is sufficient and the current that flows through the PL LEDs evolves once more as a stable periodic signal akin to the signal in phase A.

In order to alleviate this problem, the method in accordance with the invention uses the architecture that has been illustrated as an example in FIG. 1 as follows. While the lighting device, e.g. the PL and TI function, is powered based on a first input 112, an electricity supply drop on the first input 112 is detected using a detection circuit. Such electrical detection circuits are well known in the art and their functioning will not be explained in details in the context of this invention. Using controlling unit 120 an estimate of the power that will be lost from the time of detection, t, to the end of the ongoing power supply period is generated. The power converter circuit of the driver device 110 is used to generate a power supply for compensating said estimated power loss based on an electricity supply received on a second input 112', and the lighting device is powered therewith. This short time scale compensation allows for bridging the power shortage that has been illustrated in FIG. 2. In the time that lapses between the detection of the power drop on the first electricity input and the confirmation that the TI function has been switched off, the power supplied by the driver 110 to both the PL and TI functions using the second electricity input 112' is ramped up temporarily. This is for example achieved by modifying the periodic switching signal 114 of the switched-mode converter circuit in the driver device 110 accordingly.

Figure 3:
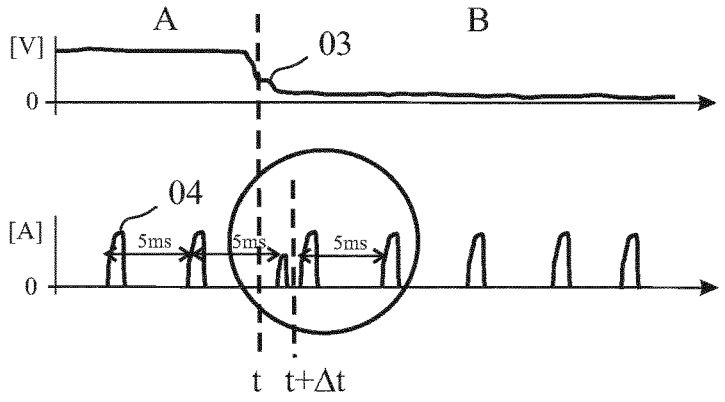
FIG. 3 illustrates the evolution in time of a power supply voltage (top) that is used to jointly supply a first and second lighting function of an automotive vehicle, and the evolution in time of the intensity of the electric current (bottom) powering the second lighting function, as observed using a driver control method in accordance with a preferred embodiment of the invention.

FIG. 3 provides an illustration of the effect of the method that is proposed, based on the example that has been given in the context of FIG. 2. The suggested architecture uses time-sharing in conjunction with a single switched mode converter circuit of a driver 110 having multiple power supply inputs 112, 112' that may be selectively used, for example to simultaneously supply different current intensities to different lighting functions of an automotive vehicle, such as parking lights, PL, turn indicator, TI. In the depicted example, during a first timespan ranging from 0 to t and labelled by the capital letter "A", a first electricity supply 112 provides input power to a switched-mode converter circuit. The output power 116 supplied by the switched-mode converter circuit is multiplexed on a time-division multiplexing basis to supply both the PL and TI functions. At time t, the electricity supply on the first input 112 of the driver 110 vanishes, and the architecture is required to use the second electricity 112' supply for powering the PL function alone. The top graph of FIG. 3 illustrates the evolution of the first electricity supply 03 as a function of time. During phase "A", the voltage 03 is applied to power both the TI and PL functions using timesharing, whereas during phase "B", starting at time t, the voltage 03 drops to zero. In parallel, a positive voltage raises starting at time t on the second electricity supply 112' available to the converter circuit, the evolution of which is not illustrated. The bottom graph of FIG. 3 illustrates the evolution of the electrical current 04 passing through light emitting diodes, LEDs, that are part of the PL lighting function. The current evolves as a pulsed periodic signal having constant period and average value during phase A as a result of the periodic power supply 116 by the driver device 110. The period, of 5 ms for example, is a function of the PWM control signal 114 that controls the switched-mode converter circuit. During phase A, the electrical current 04 is provided to the PL LEDs using the first electricity supply 112 and through the switched-mode converter circuit, using a multiplexing process through which the TI LEDs are also supplied with electrical current. At time t, the electricity supply on the first input 112 of the driver vanishes. For as long as the TI function is not confirmed to have been switched off both the TI and PL functions are required to be powered. This validation by a LED driver typically takes several milliseconds. During that time, both of the functions (TI and PL) are not powered. Then, when the loss is validated, the LED driver stops the TI function and switched from the first input 112 to the second input 112'.

This power shortage is immediately detected by the detection circuit and a compensation power value is generated by the control unit 120. The control unit then proceeds with applying an updated control signal 114 to the switched-mode converter circuit of the driver device 110, which is such that the average current intensity provided in the period that immediately follows the time of detection is such that it substantially equals the average current intensity that was provided during phase A. The generation and application of this compensatory measure is performed during a timespan $\Delta t$ that is shorter than the period of the power supply 116, so that the supposedly homogeneous luminosity of the PL LEDs is not affected during the corresponding supply cycle. In the example, the compensation is applied on PL only. The first period after input power change from 112 to 112' applies the compensation only applied to the PL function. After this first period, the available power is sufficient and the current that flows through the PL LEDs evolves once more as a stable periodic signal akin to the signal in phase A.

Clearly, the amount of compensation power that needs to be provided in accordance with the proposed method depends on the detection time t within the current power supply period. If the shortage arises at the very beginning of a power supply period, as illustrated in FIG. 3, a large compensation is required to make up for the shortage. The compensation value is generally decreasing as a function of the time of detection within a power supply period. A control unit, which may for example be implemented using a microcontroller device, may readily compute the required amount of compensation power based on the power or current intensity that is required on average for any lighting function and on the duty cycle of the default PWM control signal that is to be provided for each lighting function when no power drop is detected. This default duty cycle may then be altered accordingly to implement the compensation measure. In order to shorten the reaction time even further, pre-computed compensation values may be provided in a memory element to which the controlling unit 120 has read access. The appropriate compensation value or PWM duty cycle may then be looked up based on the observed detection time within a power supply period, without requiring any further ad-hoc computations. The microcontroller element 120 may also be used to implement the detection circuit and an analog entry of the microcontroller may be used to quickly detect the described power supply drop.

Based on the examples and illustrations that have been provided, a person with ordinary skills in the art will be able to provide a computer program for implementing the control process in accordance with aspects of the invention, without undue burden and without requiring further inventive skills.

It should be understood that the detailed description of specific preferred embodiments is given by way of illustration only, since various changes and modifications within the scope of the invention will be apparent to the skilled person. The scope of protection is defined by the following set of claims.

The invention claimed is:

1. A control method for a driver device of an automotive lighting device, wherein the driver device comprises at least two inputs for receiving one electricity supply each, and a power converter circuit for selectively converting the electricity supplied on one of the inputs into a periodic power supply for powering said lighting device, wherein the method comprises the steps of:

while the lighting device is powered based on a first input, detecting an electricity supply drop on said first input using a detection circuit;

generating, using a controlling unit, an estimate of the power that is lost from the time of detection to the end of the ongoing power supply period;

using the power converter circuit, generating a power supply for compensating said estimated power loss based on an electricity supply received on a second input, and powering said lighting device therewith.

2. The method according to claim 1, wherein the power generated during said compensation step is substantially equal to the power loss estimate.

3. The method according to claim 1, wherein said step of generating an estimate of the power that is lost from the time of detection to the end of the ongoing power supply period comprises looking up a pre-recorded power value in a memory element, which associates power values with the corresponding timing information.

4. The method according to claim 1, wherein the power converter circuit is a switched mode converter circuit, which is controlled by a periodic control signal generated by said controlling unit, and wherein during said compensation step, the control signal is adapted so that the converter circuit outputs the required compensating power.

5. The method according to claim 4, wherein said control signal is a pulse width modulated, PWM, signal, and wherein during said compensation step, the duration of the ongoing or upcoming cycle is shortened, lengthened, or the duration of the ongoing or upcoming cycle's duty cycle is altered.

6. The method according to claim 1, wherein at least one of the inputs is used to simultaneously provide a periodic power supply to at least two lighting devices using time-sharing of the driver device.

7. A control system comprising a control unit and a driver device of an automotive lighting device, wherein the driver device comprises at least two inputs for receiving one electricity supply each, and a power converter circuit for selectively converting the electricity supplied on one of the inputs into a periodic power supply for powering said lighting device, wherein control unit is configured for:

detecting an electricity supply drop on a first input using a detection circuit while the lighting device is powered based on said first input;

computing, using a controlling unit, an estimate of the power that is lost from the time of detection to the end of the ongoing power supply period;

controlling the power converter circuit, so that the power converter circuit generates a power supply for compensating said estimated power loss based on an electricity supply received on a second input, and powering said lighting device therewith.

8. The control system according to claim 7, wherein the control unit comprises a microcontroller device operatively connected to said driver device.

9. The control system according to claim 8, wherein the power converter circuit comprises a switched mode converter.

10. The method according to claim 2, wherein said step of generating an estimate of the power that is lost from the time of detection to the end of the ongoing power supply period comprises looking up a pre-recorded power value in a memory element, which associates power values with the corresponding timing information.

11. The method according to claim 2, wherein the power converter circuit is a switched mode converter circuit, which is controlled by a periodic control signal generated by said controlling unit, and wherein during said compensation step, the control signal is adapted so that the converter circuit outputs the required compensating power.

12. The method according to claim 2, wherein at least one of the inputs is used to simultaneously provide a periodic power supply to at least two lighting devices using time-sharing of the driver device.

13. The control system according to claim 9, wherein the power converter circuit comprises a switched mode converter.

14. The method according to claim 3, wherein the power converter circuit is a switched mode converter circuit, which is controlled by a periodic control signal generated by said controlling unit, and wherein during said compensation step, the control signal is adapted so that the converter circuit outputs the required compensating power.

15. The method according to claim 3, wherein at least one of the inputs is used to simultaneously provide a periodic power supply to at least two lighting devices using time-sharing of the driver device.

16. The method according to claim 4, wherein at least one of the inputs is used to simultaneously provide a periodic power supply to at least two lighting devices using time-sharing of the driver device.

17. The method according to claim 5, wherein at least one of the inputs is used to simultaneously provide a periodic power supply to at least two lighting devices using time-sharing of the driver device.

* * * * *